US005595678A

United States Patent [19]

Short et al.

[11] Patent Number: 5,595,678

[45] Date of Patent: Jan. 21, 1997

[54] LUBRICANT COMPOSITION FOR AMMONIA REFRIGERANTS USED IN COMPRESSION REFRIGERATION SYSTEMS

[75] Inventors: Glenn D. Short, Midland, Mich.; Lars I. Sjöholm, Burnsville, Minn.; Thomas E. Rajewski, Bay City, Mich.

[73] Assignee: CPI Engineering Services, Inc., Midland, Mich.

[21] Appl. No.: 298,342

[22] Filed: Aug. 30, 1994

[51] Int. Cl.[6] ..... C10M 145/26; C10M 145/34

[52] U.S. Cl. ..... 252/68; 508/579; 508/583

[58] Field of Search ..... 252/52 A, 565, 252/68; 508/579, 583

[56] References Cited

U.S. PATENT DOCUMENTS

| | | | |
|---|---|---|---|
| 4,248,726 | 2/1981 | Uchinuma et al. | 252/52 A |
| 4,267,064 | 5/1981 | Sasaki et al. | 252/52 A |
| 4,755,316 | 7/1988 | Magid et al. | 252/68 |
| 4,851,144 | 7/1989 | McGraw et al. | 252/52 A |
| 5,021,180 | 6/1991 | McGraw | 252/68 |
| 5,254,280 | 10/1993 | Thomas et al. | 252/68 |
| 5,370,812 | 12/1994 | Brown | 252/68 |
| 5,372,737 | 12/1994 | Spauschus | 252/68 |
| 5,413,728 | 5/1995 | Mall et al. | 252/68 |

FOREIGN PATENT DOCUMENTS

| | | | |
|---|---|---|---|
| 4202913 | 10/1993 | Germany | C09K 5/04 |
| 5-9483 | 1/1993 | Japan . | |

OTHER PUBLICATIONS

Briley G. C. "Lubricant (Oil) Separation", prepared for *IIAR Annual Meeting* (Feb. 1984), pp. 107–F – 131–F.

Romijn J. G. "An Oilfree Refrigeration Plant" *Grenco Support Center V.V. 's–Hertogenbosch* (Netherlands) (1987). (Month Unknown).

Green G. H., "The Effect of Oil on Evaporator Performance" *ASHRAE Meeting*, Jan. 1971 pp. 23–27.

Palmer, M. A. "Better Ways of Using Ammonia" Institute of Refrigeration *CFC Alternatives: User Experience and Update*, Nov. 1992 (abstract).

Matlock and Clinton, "Polyalkylene Glycols" In:*Synthetic Lubricants and High Performance Functional Fluids* (Marcel Dekker, Inc.) pp. 101–123 (1993). (Month Unknown).

*Mobil Oil Corp.*, "Refrigeration Compressor Lubrication with Synthetic Fluids" pp. 1–36 (1980). (Month Unknown).

Bulletin No. 108, "Water Contamination in Ammonia Refrigeration Systems" *International Institute of Ammonia Refrigeration* (IIAR) (1986) (Month Unknown).

Short G. D. "Hydrotreated Oils for Ammonia Refrigeration" prepared for *IIAR Annual Meeting* (Mar., 1985).

*Primary Examiner*—Stephen Kalafut
*Assistant Examiner*—Alan D. Diamond
*Attorney, Agent, or Firm*—Learman & McCulloch

[57] ABSTRACT

A fluid composition of suitable miscibility and solubility in ammonia, chlorofluorocarbon, hydrochlorofluorocarbon, and hydrofluorocarbon refrigerants includes and a refrigerant selected from the group consisting essentially of ammonia, chlorofluorocarbons, hydrochlorofluorocarbons, and hydrofluorocarbon refrigerants and a lubricant composition made with an organic oxide and an alcohol and comprises a polyalkylene glycol of the formula:

$$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) carbons where Z is an aryl group and a minimum number of carbon atoms of ten (10) where Z is an alkyl group, $R_1$ is hydrogen, methyl, ethyl, or a mixture thereof, N is 0 or a positive number, M is a positive number, and P is an integer having a value equal to the number of active hydrogen of Z.

32 Claims, 3 Drawing Sheets

LUBRICANT COMPOSITION FOR AMMONIA REFRIGERANTS USED IN COMPRESSION REFRIGERATION SYSTEMS

TECHNICAL FIELD

The present invention relates to fluid compositions for compression refrigeration systems for lubricating heat pumps, refrigerating compressors, and air conditioning compressors.

BACKGROUND OF THE INVENTION

It is becoming increasingly more apparent that refrigerant substitutes must be found to replace chlorofluorocarbons (CFC's) which have been found to be a major contributor to the depletion of the ozone layer. Commercial development has led to advances in the manufacture and use of refrigerants which do not contain CFC's. For example, in many refrigerant applications, the long-standing and widely-used refrigerant Freon or R-12 is being replaced by the non-chlorinated, fluorinated refrigerant HFC-134a (1,1,1,2-tetrafluoroethane). Ammonia has long served as a refrigerant and continues to be an important refrigerant. Ammonia has been found to have no effect on the depletion of the ozone layer and, equally as important, ammonia does not contribute to the greenhouse effect. The greenhouse effect is the gradual warming of the earth's atmosphere due to the build-up within the atmosphere of certain greenhouse gases such as $CO_2$ and $NO_2$. Because ammonia has a very brief atmospheric life, it does not contribute to the buildup of greenhouse gasses.

In addition, ammonia has many attractive advantages such as being a highly efficient refrigerant at a relatively low cost. On the down side, the major disadvantages of using ammonia as a refrigerant are due to its toxicity and, to a certain extent, to its flammability. However, these disadvantages have led to improved compressor and system designs which provide for more impervious barriers to prevent the escape of ammonia refrigerant from the system. Also, because of its distinctive and easily detectable odor, ammonia leaks can be more easily detected than certain other refrigerants and quickly eliminated.

The use of ammonia as a refrigerant has been limited to a certain extent due to physical and chemical interactions of ammonia with traditional refrigeration compressor lubricants. These limitations are generally the result of a lack of miscibility (liquid ammonia with lubricant) and solubility (gaseous ammonia with lubricant) of ammonia with conventional lubricants which interferes with the efficient transfer of heat and, in some cases, limits the efficient use of ammonia with certain types of heat exchangers.

It is well known in the art that traditional refrigeration lubricants such as mineral oil and synthetic hydrocarbon fluids/oils become less soluble with ammonia as temperature decreases and, thus, the lubricant can separate or drop out into system low spots such as intercoolers, suction accumulators, and evaporators.[1] As the oil migrates to the low spots in the system, it becomes necessary to add more oil to the compressor, thereby further perpetuating the problem. Elaborate means which normally require the lubricant to be drained manually from the system, such as oil stills and drain connections at the bottom of evaporators, recirculators, intercoolers, etc., have been used to remove the oil.

In the evaporator where ammonia is present in liquid form, mineral oils and synthetic hydrocarbon oils are immiscible with the liquid ammonia and the oil tends to "foul" heat exchange surfaces causing a loss of heat transfer efficiency. In evaporators where the ammonia refrigerant is present in gaseous form, mineral oils become viscous due to a lack of solubility and tend to build up in thick film on the heat transfer surfaces. This increased viscosity not only causes a loss of heat transfer efficiency, but restricts the flow of the refrigerant causing increased pressure within the system contributing to further losses in the efficiency of the system.

The function of a compressor lubricant is to provide adequate lubrication to compressor parts. To best perform this function, the lubricant should remain in the compressor rather than circulating through the entire system. Oils having low volatility characteristics will not turn into vapor at compressor discharge temperatures and, thus, may be removed with oil separators. It is inevitable, however, that the oil will naturally come into contact with the refrigerant in the compressor where it is entrained by the refrigerant in the form of small particles. Discharge side oil separators generally are not 100% efficient at separating the oil from the refrigerant, thus a certain amount of oil will pass to the condenser and the liquid receiver where it will be carried by the liquid refrigerant into the evaporator.

The presence of oil circulating through the system adversely effects the efficiency and capacity of the entire system. The major reason for this is the tendency of the oil to adhere to and to form a film on the surfaces of the condenser and evaporator tubes (or surfaces) reducing the heat transfer capacity of the condenser and the evaporator tubes. The effect of an oil film in evaporators has been shown to decrease the efficiency of a system, which can easily be 20% in an air cooler[2] to 40% or more, with increasing oil film thickness, in brine chillers.[1] It is obvious that it is desirable to maintain both compressor lubrication and system efficiency. This can best be accomplished by a lubricant with a low volatility which can be easily returned from the system to an oil reservoir where it can perform its intended lubrication function.

The Mobil Oil Corporation publication "Refrigeration Compressor Lubrication with Synthetic Fluids", which is incorporated herein by reference, discusses systems of the type with which the present invention finds use. Evaporators may be classified according to the relative amount of liquid and vapor refrigerant that flows through the evaporator. The so called dry expansion evaporator is fed by means of a flow control device with just enough refrigerant so that essentially all of the refrigerant evaporates before leaving the evaporator. In a flooded evaporator, the heat exchange surfaces are partially or completely wetted by a liquid refrigerant.

A direct expansion (DX) coil is one example of an evaporator in which a liquid refrigerant and a certain amount of flash gas is present as the refrigerant enters the evaporator. Flash gas is gas which appears when a refrigerant as a saturated liquid passes through an expansion valve undergoing a drop in pressure and instantaneously forming some gas, i.e., flash gas. As the refrigerant moves downstream through the system, the proportion of vapor increases until essentially all of the refrigerant is in vapor form before exiting the evaporator.

Shell and tube and flooded coil evaporators are both typical examples of flooded evaporators. In flooded evaporators, all of the heat transfer surfaces are wetted by the liquid refrigerant.

In an ammonia flooded evaporator, conventional mineral oils and synthetic hydrocarbon oils are essentially immiscible with ammonia. Any amount of oil entering the system tends to foul the heat transfer surfaces resulting in a loss of system efficiency. Because the oils typically are heavier than liquid ammonia, provisions must be made to remove the oil from low areas in the evaporator, as well as other low areas in the system. Additionally, an oil separator is almost always required.

In direct expansion evaporators using soluble halocarbon refrigerants, refrigerant velocity must be maintained at a sufficiently high rate at the heat exchanger outlet to effectively return the lubricant to the compressor. One study with R-12 in mineral oil[3] indicates that an oil which is miscible and has an oil content of less than 10% will have little or no effect on the heat transfer coefficient. However, it is desirable to keep oil concentration low due to the effect on pressure caused by the oil. As the oil/refrigerant mixture passes through the heat exchange tubes, it increases in viscosity due to both reduction in temperature and increased oil concentration. The increased oil concentration results in a pressure increase. This suggests that an oil/refrigerant mixture with a lower operational viscosity, particularly with some dissolved refrigerant, will reduce the effect on pressure resistance.

In the case of ammonia, normal naphthenic or paraffinic lubricants and synthetic hydrocarbon fluids/oils have low solubility and miscibility in ammonia. These oils are heavier than ammonia and tend to form an oil film on the heat transfer surfaces, or "foul", decreasing the system capacity and efficiency. The low solubility inherent with these oils also results in less dilution by the ammonia and a greater increase in refrigerant in direct expansion systems. The oil film, then, can become too thick for efficient heat transfer thereby contributing to excessive pressure increases in the evaporator and restricted oil return to the compressor.

Recently, welded plate and hybrid cross-flow plate evaporators have been proposed which would provide significant reductions in required refrigerant volume for ammonia systems. The reduction in required refrigerant volumes allows for the achievement of efficient heat transfer while also reducing the potential for ammonia refrigerant leakage.[4] The reduction in refrigerant charge volumes also enables ammonia to be safely permitted for use in a much wider variety of applications in addition to its common industrial applications. Further advantages of this type of system design includes lower system cost and reduced system size and weight. However, in order to take full advantage of this type of evaporator system, it would be desirable to use lubricants which have both a minimum effect on heat transfer efficiency and a minimum of pressure restriction in the evaporator.

Most lubricants used for refrigeration compressors with ammonia as a refrigerant are lubricated with an oil with an ISO viscosity grade (VG) of 32-68, where the ISO VG represents the approximate viscosity of the oil at 40° C. In some cases, such as with some rotary screw compressors, the ISO VG can be as high as 220. Because normal evaporators operate at a temperature of approximately −40° C., it is desirable to have a lubricant that is a fluid at −40° C. In some cases, synthetic oils are used for evaporator temperatures below −40° C., as conventional oils are usually solid at these temperatures. Improving the low temperature fluidity through selection of an oil which has a lower viscosity at evaporator temperatures helps to improve oil return. Improving the low temperature oil return represents a partial solution to the problem of the fouling of heat transfer surfaces.

Generally, with immiscible oils, a reduction in oil concentration results in a reduction in terminal oil film thickness and also increases the amount of time for the oil to reach this thickness.[2] Constant removal of oil from the system, which is assisted through improved fluidity, is one method to reduce oil concentration.

Another method useful for reducing oil concentration is to decrease the amount of oil entering the system. Oil separators are designed to remove nearly all of the liquid oil from the compressor discharge vapor. Unfortunately, these separators cannot remove oil which is in vapor form. Oil vapor passes through these separators and condenses in the condenser together with the ammonia vapor and eventually flows to the evaporator. The efficiency of these oil separators is such that the oil concentration can be as little as 0.2 parts per million in mass in the ammonia refrigerant at saturation temperatures of 25° C. to over 70 parts per million in mass at 100° C. when conventional oils are used.

The miscibility of mineral oils and synthetic hydrocarbon oils in ammonia is generally limited to less than one part per million in mass.[2] Oil scrubbers have been proposed to eliminate oil from entering the system.[2] Oil scrubbers may be suitable for large systems but are often considered undesirable for smaller systems, especially those with direct expansion evaporators where it is desirable to reduce the amount of ammonia in the system and limit weight through elimination of unnecessary piping and accessories.

Attempts have been made to overcome the problems associated with the use of ammonia refrigerant with direct expansion evaporators. An example of this is German patent DE 4202913 A1 which discloses the use of conventional mineral oil circulating through so-called dry evaporator (direct expansion). However, the circulation through the dry evaporator is limited due to both poor solubility of the ammonia refrigerant in the mineral oil lubricant and due to poor low temperature viscosity of the mineral oil lubricant. The resulting restriction to the evaporation of ammonia caused by the oil prevents efficient heat transfer.

The use of dry evaporators (direct expansion) with ammonia refrigerant is desirable, particularly in installations of relatively small and medium sized capacity, as the refrigerant capacity and, therefore, the hazard of escaping ammonia is reduced. The German patent DE 4202913 A1 also teaches the use of low molecular weight amines such as mono-, di-, and trimethylamine which are added to the ammonia refrigerant to enhance the solubility of the conventional oil (mineral oil) in the ammonia refrigerant. However, the use of amines can result in additional problems with safety. The flash point for these amines ranges from −10° C. or monomethylamine to −12.2° C. or trimethylamine. A further safety issue involves the explosive limits in air for these two amines. Monomethylamine has an explosive limit in air of 5–21%; trimethylamine has an explosive limit in air of 2–11.6%. Both of these amines are classified as being dangerous fire risks. Although ammonia is known to be flammable, the range of flammability is limited to concentrations in the air of between 16–35%. The addition of the amine component to increase the solubility of the ammonia refrigerant in the conventional mineral oil lubricant amplifies the hazardous nature of the combination and thereby limit its possible applications.

Japanese Patent Application No. 5-9483 to Kaimai et al. discloses a lubricant for ammonia refrigerants which is a capped polyether compound containing organic oxides. The Kaimai et al. reference uses R groups (R, $R_1$–$R_{10}$) which are alkyl groups having less than ten carbons in length, preferably are less than four carbons in length, to cap the ends of the lubricant molecule. Kaimai et al. teaches that the total number of carbons (exclusive of the organic oxide groups) suitable for polyether lubricants is 8 or below with alkyl groups of 1–4 carbons being preferred. Polyether lubricant compounds of greater than eight carbons were discouraged by Kaimai et al. due to incompatibility with ammonia.

Matlock and Clinton in the chapter entitled "Polyalkylene Glycols" in *Synthetic Lubricants and High Performance Functional Fluids,* which is incorporated herein by reference, discusses the class of synthetic lubricants called polyalkylene glycols. Polyalkylene glycols, also known as polyglycols, are one of the major classes of synthetic lubricants and have found a variety of specialty applications as lubricants, particularly in applications where petroleum lubricants fail. Because ammonia is more soluble in polyglycols than synthetic hydrocarbon fluids or mineral oils, it was thought that polyglycols would not offer any efficiency benefits in ammonia refrigeration systems.[6]

Polyalkylene glycol is the common name for the homopolymers of ethylene oxide, propylene oxide, or the copolymers of ethylene oxide and propylene oxide. Polyalkylene glycols have long been known as being soluble with ammonia and have been marketed for use in ammonia refrigeration applications.

U.S. Pat. No. 4,851,144 to McGraw et al., teaches a lubricant composition including a mixture of a polyalkylene glycol and esters. McGraw discloses conventional polyglycol lubricants for hydrofluorocarbon refrigerants having a hydrocarbon chain of $C_1$ to $C_8$. In order to increase the miscibility of the lubricants, McGraw teaches the addition of esters. The use of esters with ammonia lubricants is contraindicated due to the immediate formation of sludges and solids which foul heat transfer surfaces and reduce overall system efficiency.

Because polyalkylene glycols are polar in nature and, therefore, water soluble, they are not very soluble in non-polar media such as hydrocarbon. The insolubility of polyalkylene glycols in non-polar media make them excellent compressor lubricants for non-polar gasses such as ethylene, natural gas, land fill gas, helium, or nitrogen (Matlock and Clinton at page 119). Because of this polar nature, polyalkylene glycols have the potential for further becoming highly suitable lubricants for use with ammonia refrigerants. However, the same polar nature which allows polyalkylene glycols to be soluble in ammonia is the same property which allows polyalkylene glycols to be soluble in water. Solubility with water has been a long-standing concern in ammonia refrigeration applications. The presence of excessive water can result in corrosion of the refrigeration system. Bulletin No. 108 of the International Institute of Ammonia Refrigeration entitled, "Water Contamination in Ammonia Refrigeration Systems", [7] which is incorporated herein by reference, discusses the prevailing concerns associated with water contamination of ammonia refrigeration systems. The high specific volume of water as a vapor results in the need for large equipment or, conversely, if water is allowed to accumulate in excessive amounts, equipment designed for ammonia refrigeration would eventually become undersized due to the displacement of the refrigerant by the excess water volume.

It is not uncommon, especially in larger ammonia refrigeration systems, for moisture to enter the system. In the case of ammonia refrigeration systems using mineral oil lubricants, water can be easily separated from the oil before it is returned from the system to the compressor. The elimination of water in this case may be accomplished by manually "blowing out" or releasing the water just prior to its entry into the evaporator. However, because the solubility of water in conventional polyalkylene glycols ranges from a few percent to complete solubility, removal of the water becomes a more difficult task.

Another drawback for the use of conventional types of polyalkylene glycols, particularly those containing ethoxylates, as lubricants with ammonia refrigerants is that they may be too miscible to be used with flooded evaporators which were designed for mineral oils. This type of evaporator uses the lack of miscibility of mineral oil with ammonia to effect removal of mineral oil from the evaporator and subsequently returns the oil to the compressor. Because of its higher specific gravity, the mineral oil can then be drained off from the bottom of the system and returned to the compressor.

Very high levels of miscibility and solubility with ammonia can also result in a loss of lubricity. In the case of hydrodynamic lubrication, the viscosity of the oil/refrigerant mixture is important at the operating conditions, i.e., temperature and pressure of the compressor. It may be necessary to use a higher viscosity grade of polyalkylene glycol to provide the desired operating viscosity under diluted conditions for adequate fluid flow. In the case of dry exchange evaporators, the use of a lubricant with an excessively high viscosity may result in excessive diluted viscosity in the evaporator causing the accumulation of the lubricant and thus a restricted flow. This restricted flow can reduce the heat exchange efficiency of the system. Though this situation is somewhat compensated for by the high viscosity index characteristics of the polyalkylene glycols and the near complete miscibility and high solubility in the accompanying dilution of the refrigerant, boundary lubrication in the compressor may suffer because of these highly miscible polyalkylene glycols.

It is well known in the art that mineral oils have a tendency to age in ammonia refrigeration systems. This aging results in the oil breaking down and forming lighter fractions as well as forming a sludge-like material which collects within the system and which is difficult to remove. The lighter fractions contribute to the problems associated with providing an effective method for separating the oil from the refrigerant because the lighter fractions of oil become vapor thereby preventing the oil from entering into the refrigeration system.

The sludge-like materials, which are essentially insoluble in mineral oils, drop out of solution and form deposits which contribute to the "fouling" of heat exchanging surfaces throughout the system and may further interfere with the operation of values and other mechanical devices. It, therefore, becomes imperative to provide a mechanism which prevents the build up of sludge-like materials. One such method would be to provide a lubricant which resists aging.[8]Another method would be to provide a mechanism for removing the sludge build-up. The simplest method would be to add fresh oil to the system to flush out or dissolve the sludge-like material. However, mineral oils and synthetic oils have little or no capacity to dissolve the sludge-like materials formed in ammonia refrigeration system.

Because of the good solvency characteristics of polyalkylene glycols, these lubricants could provide a very viable alternative lubricant source for the conversion or retro-fitting of systems previously using lubricants such as mineral oil. That is, by switching to polyalkylene glycol lubricants, the build-up of sludge-like materials can be removed on changeover.[5]

Heretofore, the prior art in the field of polyalkylene glycol-based lubricants was void of any lubricant which encompassed the necessary properties of refrigeration compressor lubricants for ammonia refrigerants. These key properties include miscibility, solubility, compatibility with mineral oils and synthetic hydrocarbon oils/fluids, low volatility, water insolubility, lubricity, and rheology (viscosity temperature characteristics).

The present invention relates to improved lubricant fluids and their method of manufacture resulting in fluids having an excellent balance of miscibility, solubility, and viscosity, thereby making the fluids excellent lubricants for ammonia compression refrigeration systems. The present invention provides polyalkylene glycol lubricants having better miscibility and solubility characteristics than mineral oils, synthetic hydrocarbon fluids/oils, and previously known polyalkylene glycol lubricants.

SUMMARY OF THE INVENTION

In accordance with the present invention, there is provided a fluid composition of suitable miscibility and solubility in ammonia, chlorofluorocarbon, hydrochlorofluorocarbon, and hydrofluorocarbon refrigerants and a refrigerant selected from the group consisting essentially of ammonia, chlorofluorocarbons, hydrochlorofluorocarbons, and hydrofluorocarbon refrigerants and a lubricant composition made with an organic oxide and an alcohol and comprises a polyalkylene glycol of the formula:

$$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) carbons where Z is an aryl group and a minimum number of carbon atoms of ten (10) where Z is an alkyl group, $R_1$ is hydrogen, methyl, ethyl, or a mixture thereof, N is 0 or a positive number, M is a positive number, and P is an integer having a value equal to the number of active hydrogen of Z.comprising polyalkylene glycols made with an alcohol for initiating formation of the polyalkylene glycols with an organic oxide. The polyalkylene glycol lubricants of the present invention are of the formula:

$$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) carbons where Z is an aryl group and a minimum number of carbon atoms of ten (10) where Z is an alkyl group, $R_1$ is hydrogen, methyl, ethyl, or a mixture thereof, N is 0 or a positive number, M is a positive number, and P is an integer having a value equal to the number of active hydrogen of Z and have unexpected physical characteristics including miscibility-solubility in ammonia, chlorofluorocarbons, hydrochlorofluorocarbons, and hydrofluorocarbon refrigerants, compatibility with mineral oils and synthetic hydrocarbon oils/fluids, low volatility, water insolubility, lubricity, and rheology (viscosity temperature characteristics).

The present invention further provides a method of making a fluid composition for use in a compression refrigeration system including combining a refrigerant and a lubricant composition comprising a polyalkylene glycol made with an alcohol and an organic oxide.

The present invention further provides a lubricant for compression refrigeration made by the process of combining an alcohol and an organic oxide to form the polyalkylene glycol lubricant.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 shows the miscibility of a representative lubricant composition of the present invention the with hydrofluorcarbon refrigerant HFC-134a;

DETAILED DESCRIPTION OF THE INVENTION

Figure 1:
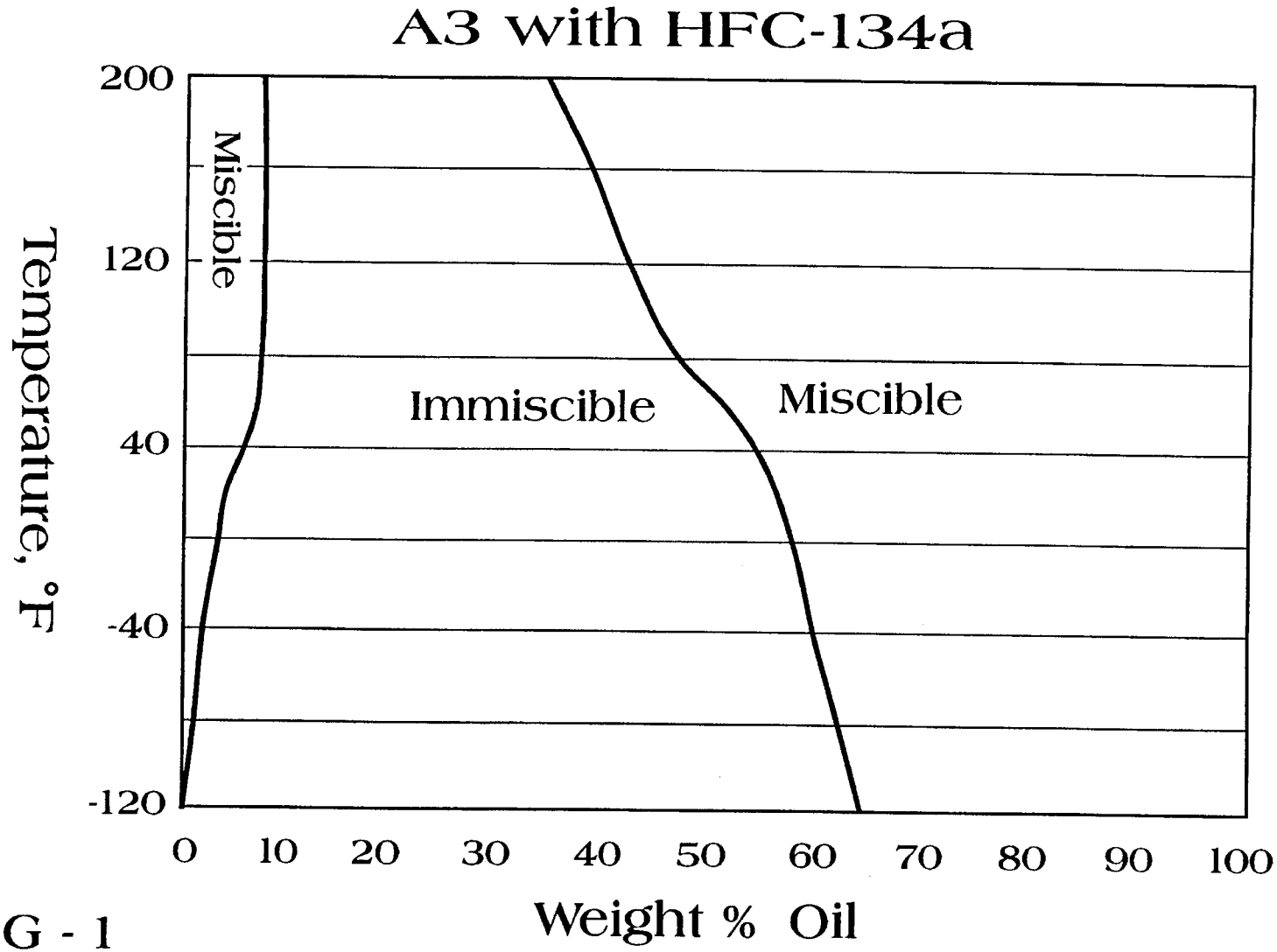

A lubricant composition made in accordance with the present invention includes a polyalkylene glycol of the general formula:

$$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) carbons where Z is an aryl group and a minimum number of carbon atoms of ten (10) where Z is an alkyl group, $R_1$ is hydrogen, methyl, ethyl, or a mixture thereof, N is 0 or a positive number, M is a positive number, and P is an integer having a value equal to the number of active hydrogen of Z, the lubricant comprising an organic oxide and an alcohol for initiating the formation of the polyalkylene glycol. The alcohol/initiator is characterized by a chemical structure which contains a larger number of carbon atoms in relationship to the number of active hydrogen atoms. The lubricant composition is further characterized by having a ratio of molecular weight of the alcohol to the molecular weight of the composition of between about 8–55%. The alcohol provides a hydrocarbon chain which acts as a means for controlling both the solubility and miscibility of the lubricant in ammonia while at the same time reducing the solubility of the lubricants with water. Additionally, the hydrocarbon chain facilitates compatibility of the lubricants with mineral oils. Since the hydrocarbon chain is hydrophobic and non-polar it is insoluble in ammonia. This insolubility provides for a means for adjusting and controlling both solubility and miscibility in ammonia. In addition, the greater the length of the hydrocarbon chain, the better the lubricative properties of the lubricant.

The hydrocarbon chain is also referred to as the initiator. The term initiator denotes that an alcohol initiates or commences the formation of the polymeric structure which becomes the polyalkylene glycol. Unlike a catalyst, part of the initiator (Z) becomes a part of polyalkylene glycol which is produced. That is, the initiator is not regenerated like a true catalyst but, actually facilitates the formation polyalkylene glycol.

The initiator used can include any alcohol but, preferably the initiator includes alcohols including the following:

| Carbon | Chemical | Formula |
|---|---|---|
| C7 | benzyl alcohol | $C_6H_5CH_2OH$ |
| C11 | undecyl alcohol | $CH_3(CH_2)_{10}OH$ |
| C14 | octyl phenol | $C_8H_{17}C_6H_4OH$ |
| C15 | nonyl phenol | $C_9H_{19}C_6H_4OH$ |
| C24 | di-nonyl phenol | $(C_9H_{19})_2C_6H_4OH$ |

Preferably the initiator used in the formation of the lubricant composition is an alcohol having a total carbon number greater than ten ($>C_{10}$) for alkyl hydrocarbons and a total carbon number greater than six ($>C_6$) for aryl hydrocarbons.

Other alcohol/initiator compounds which are useful include phenol, methyl phenol, ethyl phenol, propyl phenol, and other similar derivatives of phenol.

The organic oxides useful in the present invention can include any organic oxide but, the most preferable, ethylene oxide, propylene oxide, butylene oxide or mixtures thereof.

In accordance with the present invention, applicants have determined alcohols/initiators with a chemical structure containing larger amounts of carbon atoms in relationship to the number of active hydrogens provides for excellent properties of both miscibility and solubility. That is, for example, typical prior art initiators for common polyglycols or polyalkylene glycols are water (no carbons) amines (no carbons), short chain alcohols such as methanol, ethanol, butanol or short chain polyols such as glycerol or ethylene glycols are used in the formation of the polyalkylene glycols. The ratio of the molecular weight of these prior art alcohols/initiators to the total weight of the alcohols/initiators of the polyalkylene glycol molecule formed is approximately 1–7%. In contrast, applicants have found that by using alcohols/initiators containing larger amounts of carbon atoms in relationship to the number of active hydrogens atoms, that the ratio of molecular weight of the alcohol/initiator to the total weight of the polyalkylene glycol molecule formed is in the range of 8–55%.

Applicants have determined that polymers of organic oxides, such as ethylene oxide, propylene oxide, butylene oxide and mixtures thereof further contribute to the excellent properties of the lubricants in ammonia. In addition to contributing to the miscibility characteristics of the lubricant composition in ammonia, the organic oxide, such as ethylene oxide, can be used to modify the solubility characteristics of the lubricant in ammonia as well. The polyalkylene glycols are homo- or co-polymers of the various organic oxides. By blending various mixtures of organic oxides, applicants have found that other characteristics such as miscibility/solubility, pour point temperature, and water solubility can be modified. By modifying the relative amounts of the organic oxides, the solubility and miscibility of the lubricants in ammonia can varied. Since the affinity of the organic oxides for ammonia decreases with increasing carbon number, ethylene oxide>propylene oxide>butylene oxide, the ammonia miscibility and solubility characteristics can be tailored by combining the organic oxides to form a lubricant having the desired levels of miscibility and solubility.

The water solubility of the lubricant can, for example, be modified (decreased) by forming polymers of propylene oxide. This polymer is generally less polar because the extra carbon on the propylene oxide blocks or hinders the oxygen atom and, therefore, the lubricant formed using this organic oxide is less soluble in water. By having a larger amount of carbon atoms comprising the lubricant, water solubility is reduced, however; water solubility can be increased, if desired, by adding a more hydrophilic organic oxide such as ethylene oxide. Other combinations of oxides can be used in order to adjust or tailor the properties of the lubricant to meet specific needs or applications.

Preferably there is a sufficient amount of the lubricant in the compressor to provide lubrication and sealing. In dealing with the compressor, the lubricating fluid is thought of as a solution of refrigerant dissolved in the lubricant. Such a composition generally comprises a majority of lubricant. Of course, depending on the compressor conditions and system design, the ratio of refrigerant to lubricant could be a very high concentration. In other parts of the refrigeration system such as the evaporator, the lubricant may be thought of as dissolved in the refrigerant. Refrigerants are classified as completely miscible, partially miscible, or immiscible with lubricants depending on their degree of mutual solubility. Partially miscible mixtures of refrigerant and lubricant are mutually soluble at certain temperatures and lubricant-in-refrigerant concentrations, and separate into two or more liquid phases under other conditions.

Applicants have found that in order to produce an ideal polyalkylene glycol lubricant for use with ammonia, the lubricant must be soluble in gaseous ammonia without being overly soluble in gaseous ammonia and miscible in liquid ammonia without being overly miscible in liquid ammonia. By "ideal" it is meant that the degrees of solubility and miscibility are adjusted to meet the needs of a particular system. Typically, miscibility comes with increased solubility. For certain systems the ideal lubricant would be soluble, thereby reducing viscosity, without being miscible. A lubricant which is overly soluble in gaseous ammonia would cause foaming or dilution due to the excess amount of ammonia entrained in the lubricant. An overly miscible lubricant can be defined as having a critical separation temperature below that of the evaporator condition. An ideal lubricant would separate from the liquid refrigerant allowing for efficient collection and return to the compressor. A highly soluble conventional polyalkylene glycol lubricant also tends to be highly miscible in ammonia. That is, the lubricant will stay miscible in a single clear phase with ammonia even at very low temperatures. This miscibility prevents effective separation of the lubricant from liquid ammonia and results in the subsequent return of excess amounts of ammonia to the compressor. Another problem with highly soluble lubricants arises from foaming caused by the cycle of increasing the pressure of a refrigeration system (to dissolve gaseous ammonia) and then decreasing the pressure of the system. Gaseous ammonia is release during the decrease in pressure causing foaming of the lubricant within the system.

By varying the oxides used in the formation of the polyalkylene glycol lubricants of the present invention, solubility and miscibility characteristics can be optimized for a given application or system.

The lubricant composition of the present invention is a polyalkylene glycol with a molecular weight ranging from 200 to 4000. The preferred molecular weight range for suitable for use with ammonia refrigerants ranges from 400 to 2000.

The viscosity of the lubricant composition @ 40° C. can be adjusted between 10 to 500 cSt depending on the particular viscosity required for a given application or system. The preferred viscosity of the lubricant composition @40° C. is between 25 to 150 cSt.

The lubricant composition can further include the polyalkylene glycols of the present invention blended with or formulated to include other more common lubricants such as common polyglycols, mineral oils, and alkylbenzene based fluids. These more common lubricants could be blend or mixed with the polyalkylene glycols of the present invention in percentages ranging from 10 to 25% without completely compromising the improved properties of the fluids of the present invention. These lubricant blends or formulations could be used for systems or applications which require that the lubricant be compatible with preexisting lubricant requirements such as retro-fitted systems, i.e., systems converted from mineral oil lubrication to polyalkylene glycol lubrication, systems converted from CFC based refrigerants to ammonia based refrigerants, or as naturally occurring by-products of retro-fitted systems, i.e., mixing of lubricants of the present invention with residual or existing lubricants in a system. In other words, the ability of the lubricants of the present invention to function in these blends may be necessary to achieve compatibility with preexisting refrigeration systems or lubricants.

Preferably, the composition includes at most 20 to 25% of the common polyglycol, mineral oil, or alkyl benzene. The composition, including additives or blends of up to 25% of the common polyglycol, mineral oil, or alkyl benzene with the base fluid composition of the present invention is found to improve certain characteristics of the composition of the present invention such as compatibility with systems previously utilizing any one of either common polyglycol lubricants, mineral oil lubricants, or alkyl benzene lubricants. The blending of common polyglycols, mineral oil, or alkyl benzene can be accomplished without impairing the improved properties and characteristics of the lubricants of the present invention.

The lubricant compositions may also be understood to include the usual additions such as anti-oxidants, corrosion inhibitors, hydrolysis inhibitors, etc., such as identified in U.S. Pat. No. 4,851,144 which is incorporated herein by reference. The percentages used in the foregoing description and claims are to be considered as the compositions defined prior to the additions of such additives.

In order to be suitable lubricants for both ammonia refrigeration systems and chlorofluorocarbon (CFC), hydrofluorocarbon (HFC), or hydrochlorofluorocarbon (HCFC) refrigeration systems (retro-fit or conversion refrigeration systems), the polyalkylene glycol lubricants of the present invention must be able to be formulated in order to be compatible with these refrigerants. By the term compatible it is meant that the lubricants possess properties such as miscibility, solubility, viscosity, volatility, lubricity, thermal/chemical stability, metal compatibility, and floc point (for CFC and HCFC applications) such that the lubricant functions properly in the chosen refrigerant environment. In addition, compatibility also encompasses solubility in mineral oil. That is, the polyalkylene glycols of the present invention are soluble in conventional mineral oil lubricants. This solubility in mineral oil provides an indication of the compatibility and, possibly, the interchangeability of the lubricants of the present invention with conventional mineral oil lubricants. This interchangeability is an especially important property in system retro-fitting with new lubricants or in system conversions from non-ammonia refrigerants to ammonia refrigerants. In view of the above, the present invention provides a fluid composition including the lubricant composition as described above and a refrigerant such as ammonia, chlorofluorocarbons, hydrochlorofluorocarbons, and hydrofluorocarbons. That is, the subject lubricant can be mixed with or added to ammonia as well as non-ammonia refrigerants in order to provide a fluid composition suitable for compression refrigerator equipment. The amount of lubricant added to the fluid composition depends on the type of system being used and the requirements of the system all of which is known to those skilled in the compression refrigeration arts.

Also in view of the above, the present invention provides a method of lubricating compression refrigeration equipment by using a lubricant composition comprising an alcohol/initiator and an organic oxide characterized by the chemical structure of the hydrocarbon chain, provided by the alcohol, containing a larger amount of carbon atoms in relationship to the amount of active hydrogen atoms and wherein the ratio of the molecular weight of the hydrocarbon chain to the molecular weight of the composition is between approximately 8 to 55%. That is, the subject fluid composition can be mixed with refrigerants such as ammonia, CFC's, HCFC's (such as HCFC-22 (R-22)), and HFC's (such as HFC-134a (R-134a)) to provide lubrication in compression lubrication equipment.

Also in view of the above, the present invention provides a lubricant for compression refrigeration made by the process of combining a polyalkylene glycol comprising an alcohol/initiator for initiating formation of the polyalkylene glycol from an organic oxide. The hydrocarbon chain used to make the lubricant by the process is characterized by a chemical structure which contains a larger amount of carbon atoms in relationship to active hydrogen atoms and wherein the composition has a ratio of molecular weight of the hydrocarbon chain or initiator to molecular weight of the composition of about 8 to 55%. That is, the subject lubricant can be made by combining the lubricant with refrigerants such as ammonia, CFC's, HCFC's, and HFC's to provide a lubricant suitable for compression lubrication equipment.

EXAMPLES

Table 1 demonstrates the physical composition of various lubricant compositions. The fluids designated by "A", A-1–A-10, are lubricant fluids prepared in accordance with the present invention. The fluids designated by "B", B-1–B-6, are examples of fluid compositions of conventional polyglycols. The fluid compositions designated by "C", C-1–C-3, represent examples of mineral oils and alkyl benzene lubricant compositions. More specifically, Table 1 indicates the alcohol/initiator and organic oxide compositions of several lubricant compositions formulated in accordance with the present invention.

Table 2 demonstrates physical properties of compositions as described in Table 1. Table 2 also demonstrates the effect of the addition of ethylene oxide on the mineral oil solubility of the lubricant composition at 70° F. Table 2 also demonstrates other physical properties such as flash point, fire point, pour point in degrees Centigrade (° C.), water solubility at 68° F., and viscosity at 40° C. Table 2 also demonstrates that the compounds A-1–A-10 have viscosities at 40° C. suitable for most refrigeration applications.

Table 3 demonstrates the miscibility of the lubricants of the present invention as compared to conventional polyglycols, mineral oil, and alkyl benzene. As can be seen from Table 3, ethylene oxide can be used to control the miscibility characteristics of the lubricants while maintaining some of the mineral oil solubility as shown in Table 2.

Applicants further conducted Falex tests on selected compounds. Falex tests, described as follows, were run with a steel pin and V-block in an ammonia environment. The loading device was engaged to produce a load of 250 pounds for one minute and 350 pounds for one hour. Wear to the steel pins was measured in terms of weight loss. The results are shown on Table 4. The results showed that as a whole the lubricants of the present invention provided better lubrication and, therefore, less wear to the metal surface than did either the conventional polyglycol lubricants or the mineral oil lubricant.

Table 5 illustrates the solubility of the lubricant compositions in ammonia. As can be seen from the table, the fluids of the present invention are soluble in ammonia at 70° F.

Table 6 illustrates the stability of the lubricant compositions of the present invention in a high temperature ammonia environment. The table illustrates that, as a whole, the lubricant compositions A1 through A10 exhibited as good or better high temperature stability than the conventional polyglycol lubricants, mineral oil lubricants, and alkyl benzene lubricant. The results indicate that the lubricants of the present invention are stable in this environment. Two ounce samples of the lubricants were combined with a polished steel catalyst and were tested @ 90 psig and 285° F. for a period of one month.

Applicants conducted further Falex tests on selected compounds. Falex Run-In tests (ASTM D-3233), described as follows, were run with a steel pin and V-block in a non-ammonia environment (air). The loading device was engaged to produce a load of 300 pounds for five minutes at an oil temperature of 52° C. After five minutes, the loading device was reengaged and the load was increased until failure occurred. The results shown in Table 7 represent the amount of load (pounds) at the time of failure in a non-ammonia environment. The results showed that as the carbon number of the lubricant increased, so did the load required to cause failure. Capped polyethers were shown to provide less lubricity than the lubricants of the present invention.

Table 8 illustrates the results of Falex Run-In testing (ASTM-3233). The test conditions were the same as described for Table 7 except the tests were performed in an ammonia environment. The results shown in Table 8 illustrate that in an ammonia environment, the lubricants of the present invention provide superior lubricity than the capped polyether lubricants tested.

Table 9 illustrates the reduced foaming characteristics of the lubricants of the present invention Tests were conducted @ 90° C., 100 ml of lubricant was placed in a graduated cylinder and ammonia (flow rate 5.2 L/Hr.) was aspirated through the lubricant. The amount of foaming was measured in terms of volume change. Lubricants of the present invention foamed less than a conventional polyglycol lubricant.

FIG. 1 shows the miscibility limits of lubricant A3 with refrigerant HFC-134a. A3 is a reaction product of nonyl phenol and propylene oxide. The miscibility range over a broad temperature range is shown at a broad weight percentage oil range up to the limit of testing.

Figure 2:
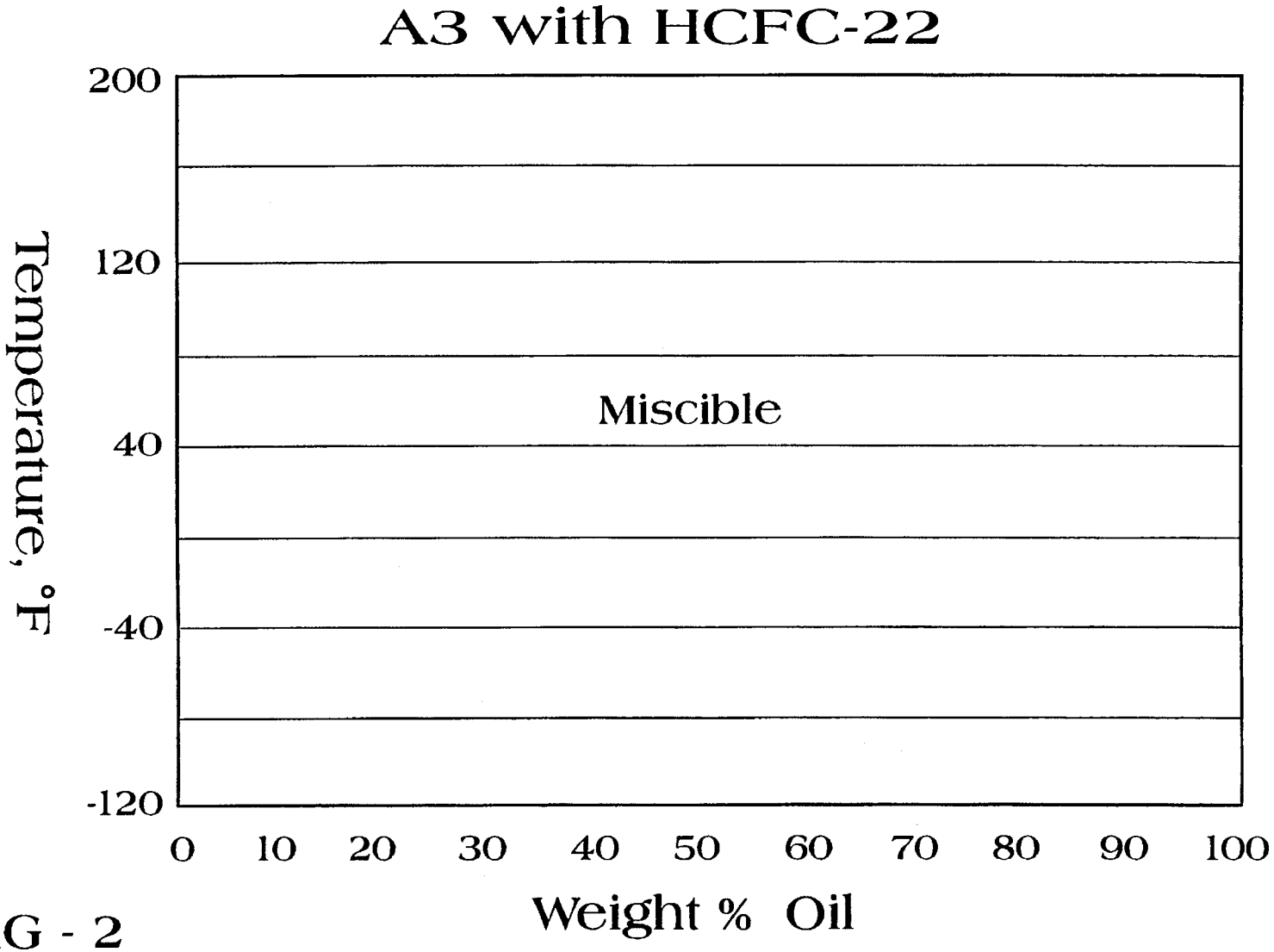
FIG. 2 shows the miscibility of a representative lubricant composition of the present invention with the hydrochlorofluorocarbon refrigerant HCFC-22.

FIG. 2 shows the miscibility limits of lubricant A3 with the refrigerant HCFC-22. As can be observed from FIG. 2, A3 is completely miscible with HCFC-22. A3 is a reaction product of nonyl phenol and propylene oxide. The miscibility range over a broad temperature range is shown at a broad weight percentage oil range up to the limit of testing.

Figure 3:
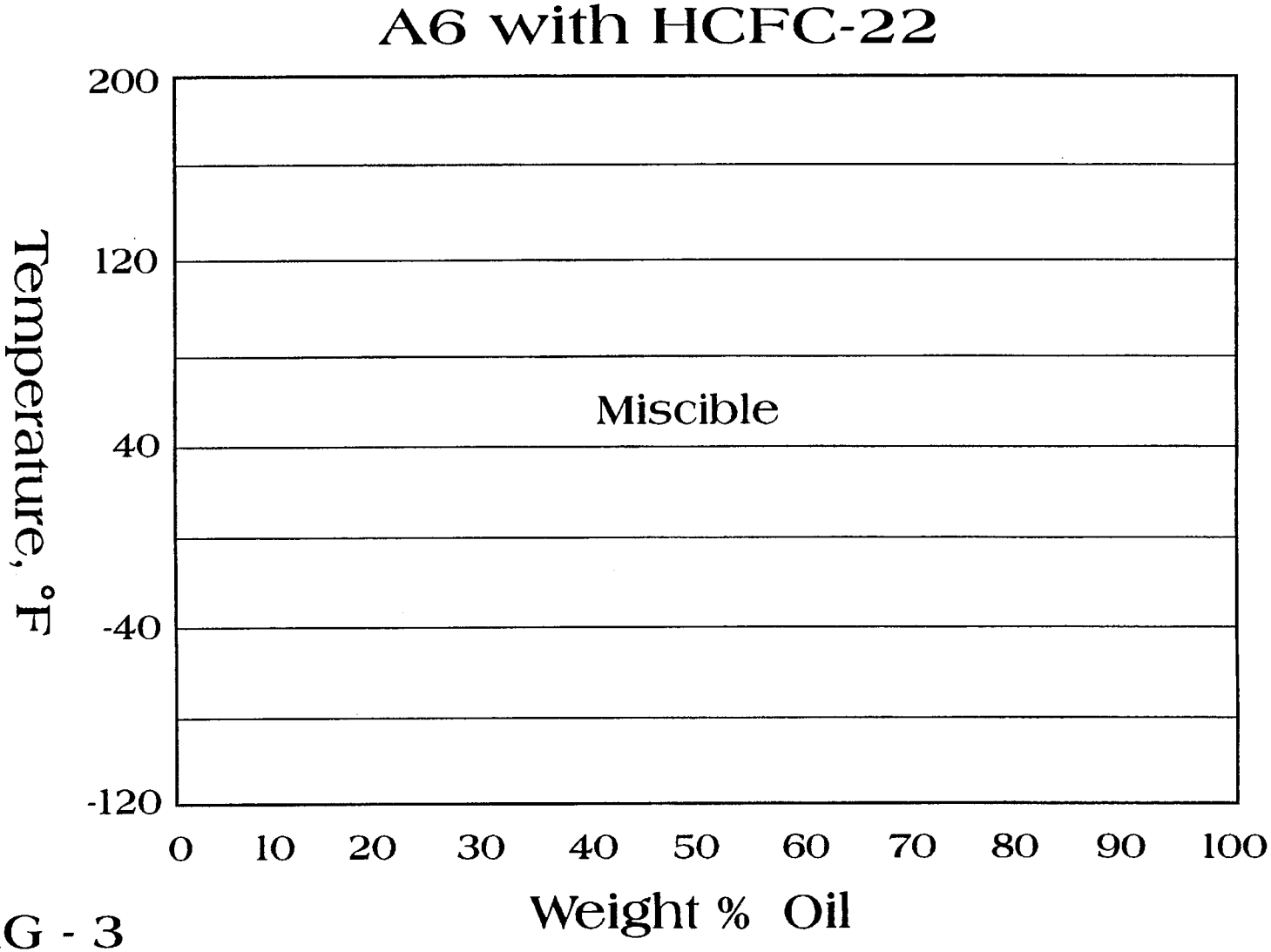
FIG. 3 shows the miscibility of a second representative lubricant composition of the present invention with the hydrochlorofluorocarbon refrigerant HCFC-22.

FIG. 3 shows the miscibility limits of lubricant A6 with the refrigerant HCFC-22. As can be observed from FIG. 3, A6 is completely miscible in HCFC-22. A6 is a reaction product of a $C_{11}$ alcohol and propylene oxide. The miscibility range over a broad temperature range is shown at a broad weight percentage oil range up to the limit of testing.

In view of the above data, it can be concluded that applicants have shown improved solubility and miscibility characteristics with ammonia and hydrocarbon refrigerants, hydrolytic stability, lubricity, the viscosity index, compatibility with mineral oil, water insolubility (low water solubility), and volatility.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

TABLE 1

| | | COMPOSITION | | | | | | |
|---|---|---|---|---|---|---|---|---|
| FLUID ID | INITIATOR | % EO | % PO | % BO | APPROX. MOL. WT. | COMMERCIAL NAME | MOLES | % INITIATOR |
| A-1 | Benzyl Alcohol | — | 100 | — | 650 | | 9.1 moles PO | 16.62 |
| A-2 | Octyl Phenol | — | 100 | — | 737 | | 9.0 moles PO | 27.95 |
| A-3 | Nonyl Phenol | — | 100 | — | 840 | | 10.4 moles PO | 26.19 |
| A-4 | Nonyl Phenol | — | 100 | — | 786 | | 11.4 moles PO | 27.99 |
| A-5 | Di-Nonyl Phenol | — | 100 | — | 750 | | 6.6 moles PO | 46.13 |
| A-6 | $C_{11}$ Alcohol | — | 100 | — | 1800 | | 27.6 moles PO | 8.83 |
| A-7 | Nonyl Phenol | 100 | — | — | 420 | | 4.5 moles EO | 52.38 |
| A-8 | Nonyl Phenol | 100 | — | — | 630 | | 9 moles EO | 34.92 |
| A-9 | Nonyl Phenol | 50[x] | 50[x] | — | 736 | | 5.2 moles PO<br>4.5 moles EO | 29.89 |
| A-10 | Nonyl Phenol | 75[x] | 25[x] | — | 680 | | 2.6 moles PO<br>6.75 moles EO | 32.35 |

TABLE 1-continued

| FLUID ID | INITIATOR | % EO | % PO | % BO | APPROX. MOL. WT. | COMMERCIAL NAME | MOLES | % INITIATOR |
|---|---|---|---|---|---|---|---|---|
| | | | | COMPOSITION | | | | |
| B-1 | Butyl Alcohol | 50* | 50* | — | 1800 | | 14.88 moles PO 19.61 moles EO | 4.1 |
| B-2 | 1,4 Butyl Alcohol | — | 100 | — | 2000 | | 34 moles PO | 4.5 |
| B-3 | — | — | — | 100 | 2000 | | 27.3 moles BO | — |
| B-4 | — | — | — | 100 | 1000 | | 13.4 moles BO | — |
| B-5 | Butyl Alcohol | 50* | 50* | — | 1000 | | 8.6 mole PO 11.36 mole EO | 7.4 |
| C-1 | — | — | — | — | 380 | RO-30 Mineral Oil | — | — |
| C-2 | — | — | — | — | 430 | CP-1009-68 HT | — | — |
| C-3 | — | — | — | — | 320 | RF-300 Alkyl Benzene | — | — |

*A9, A10 - % by Volume
*B-1 % by wt.

TABLE 2

| | FLASH | FIRE | POUR POINT °C. | WATER SOLUBILITY @ 68° F. | VISC @ 40° C. (cSt) | APPROXIMATE MINERAL OIL SOLUBILITY @ 70° F. |
|---|---|---|---|---|---|---|
| | | | | PHYSICAL PROPERTIES | | |
| A1 | 440 | 455 | −42 | 4.57% | 30.76 | 16% (Both phases clear) |
| A2 | 450 | 515 | −33 | 1.85% | 97.76 | 100% (Hazy) |
| A3 | 470 | 530 | −33 | 1.12% | 97.66 | 100% (Single, hazy phase) |
| A4 | 480 | 545 | −33 | 1.50% | 97.80 | 100% (Single, hazy phase) |
| A5 | 485 | 505 | −27 | 0.79% | 131.36 | 100% (Single, clear phase) |
| A6 | 460 | 480 | −45 | 1.76% | 93.73 | 24% (Both phases hazy) |
| A7 | 440 | 455 | −20 | Forms Gel | 81.49 | 100% |
| A8 | 505 | 510 | 3 | 100% | 91.68 | 100% |
| A9 | 510 | 550 | −15 | Gels/Cloudy | 97.26 | 100% (Single hazy phase) |
| A10 | 505 | 545 | −6 | 100% | 92.05 | 100% (Single hazy phase) |
| B1 | 460 | 490 | −45 | 100% | 128.87 | 4% (Both phases hazy) |
| B2 | 450 | 465 | −40 | 3.624% | 104.40 | 10% (Both phases hazy) |
| B3 | 440 | 485 | −26 | .2027% | 196.29 | 100% (Single, clear phase) |
| B4 | 440 | 460 | −26 | .5644% | 85.01 | 100% (Single, clear phase) |
| B5 | 470 | 515 | −62 | 100% | 55.61 | 100% (Single, cloudy phase) |
| C1 | 340 | 355 | −36 | .0077% | 63.80 | 100% |
| C2 | 470 | 485 | −35 | 0.025% fluid hazy | 65.83 | 100% |
| C3 | 370 | 380 | −40 | 0.0052% | 50.10 | 100% |

TABLE 3

| FLUID ID | MISCIBILITY RANGE (180° F. Max. test Temp.) | |
|---|---|---|
| | MISCIBILITY WITH AMMONIA | |
| A1 | [10%] | 10–180° F. |
| | [40%] | 10–180° F. |
| A2 | [10%] | 70–180° F. |
| | [40%] | 70–180° F. |
| A3 | [10%] | 135–180° F. |
| | [40%] | 110–180° F. |
| A5 | [10%] | 130–180°0 F. |
| | [40%] | Partially miscible from 160 to 180° F. |
| A6 | [7.75%] | 158–180° F. |
| | [27%] | 158–180° F. |

TABLE 3-continued

| FLUID ID | MISCIBILITY RANGE (180° F. Max. test Temp.) | |
|---|---|---|
| | MISCIBILITY WITH AMMONIA | |
| A8 | [10%] | −75–180° F. |
| | [40%] | −75–180° F. |
| A9 | [10%] | 39–180° F. |
| | [40%] | 5–180° F. |
| B1 | [10%] | −10–180° F. |
| | [40%] | −20–180° F. |
| B2 | [10%] | 48–180° F. |
| | [40%] | 37–180° F. |
| B4 | [10%] | 113–180° F. |
| | [40%] | 113–180° F. |

TABLE 3-continued

| MISCIBILITY WITH AMMONIA | | |
|---|---|---|
| FLUID ID | MISCIBILITY RANGE (180° F. Max. test Temp.) | |
| B5 | [10%] | −66–180° F. |
| | [40%] | −65–180° F. |
| C1 | [10%] | Immiscible |
| | [40%] | Immiscible |
| C3 | [10%] | Immiscible |
| | [40%] | Immiscible |

TABLE 4

| FALEX WEIGHT LOSS | |
|---|---|
| FLUID ID | TOTAL PIN and V-BLOCKS |
| A1 | 11.4 mg |
| A2 | 4.7 mg |
| A3 | 12.2 mg |
| A5 | 11.8 mg |
| A6 | 11.9 mg |
| A7 | 16.1 mg |
| A9 | 5.8 mg |
| B2 | 13.1 mg |
| B3 | 21.9 mg |
| C1 | 29.7 mg |

Conditions
AISI 1137 Steel v-blocks WI AISI 3135 steel pins
Ammonia bubbled through at approximately 7.8 liters/hour
60° C. test temp.
1 minute at 250 lbs.
1 hr. at 350 lbs

TABLE 5

| AMMONIA SOLUBILITY | |
|---|---|
| FLUID ID | @ 70° F. |
| A1 | 2.37% |
| A3 | 2.18%% |
| A6 | 0.5% |
| A7 | 16.88% |
| A8 | 7.5% |
| B5 | 7.7% |
| C1 | 0.52% |
| C2 | 0.39% |

TABLE 6

| HIGH TEMPERATURE AMMONIA STABILITY | | | | |
|---|---|---|---|---|
| FLUID ID | DESCRIPTION | | | |
| A1 | 1) Slight | 2) None | 3) Lt. Yellow | 4) Good |
| A2 | 1) Slight | 2) None | 3) Med. Amber | 4) Good |
| A3 | 1) None | 2) None | 3) Lt. Yellow | 4) Perfect |
| A5 | 1) None | 2) None | 3) Med. Amber | 4) Good |
| A7 | 1) Slight | 2) Slight | 3) Med. Yellow | 4) Good |
| A8 | 1) Slight | 2) Slight | 3) Med. Amber | 4) Good |
| A9 | 1) Slight | 2) None | 3) Lt. Yellow | 4) Good |
| A10 | 1) Slight | 2) None | 3) Med. Yellow | 4) Good |
| B1 | 1) None | 2) Slight | 3) Med. Amber | 4) Good |
| B2 | 1) Medium | 2) Slight | 3) Med. Yellow | 4) Good |
| B3 | 1) Slight | 2) Slight | 3) Lt. Yellow | 4) Good |
| B4 | 1) Medium | 2) Slight | 3) Med. Amber | 4) Good |
| B5 | 1) Slight | 2) Slight | 3) Dk. Amber | 4) Good |
| C1 | 1) Medium | 2) Slight | 3) Dk. Amber | 4) Fair |
| C2 | 1) Medium | 2) None | 3) Clear | 4) Perfect |
| C3 | 1) Medium | 2) Medium | 3) Lt. Yellow | 4) Fair |

TABLE 6-continued

| HIGH TEMPERATURE AMMONIA STABILITY | |
|---|---|
| FLUID ID | DESCRIPTION |
| 1) Catalyst Tarnishing | |
| 2) Precipitate | |
| 3) Color | |
| 4) Overall Appearance | |

TABLE 7

| Falex Run-In Test (ASTM D-3233) without Ammonia | |
|---|---|
| Fluid | Jaw Load (pounds) @ failure |
| A3 | 950 |
| A6 | 1050 |
| A9 | 1250 |
| Capped Polyglycol (polyether) 56 cSt | 900 |
| Capped Polyglycol (polyether) 46 cSt | 800 |

Oil Temperature of 52 C.
Jaw load of 300 lbs. for 5 minutes
engaged ratchet until failure

TABLE 8

| Falex Run-In Test (ASTM-3233) with Ammonia | |
|---|---|
| Fluid | Jaw Load (pounds) @ failure |
| A3 | 1200 |
| A6 | 1100 |
| A9 | 1270 |
| Capped Polyglycol (polyether) 56 cSt | 925 |
| Capped Polyglycol (polyether) 46 cSt | 1025 |

Ammonia bubbled through oil @ flow rate of 5.2 L/hour for 15 minutes prior to test
Oil Temperature of 52 C.
Jaw Load of 300 lbs. for 5 minutes
engaged ratchet until failure

TABLE 9

| Foam Test with Ammonia | | |
|---|---|---|
| Fluid | Foam | Increase in volume |
| A3 | none | no increase |
| A9 | 5 mL | 3 mL |
| B5 | 10 mL | 5 mL |

100 mL fluid placed in graduated cylinder
90° C. test temperature
ammonia flow of 5.2 L/hour
ammonia aspirated for five minutes then volume increase and foam noted

REFERENCES CITED

1. Briley, "Lubricant (Oil) Separation", IIAR Annual Meeting (February 1984), pp. 107-F–131-F
2. Romijn, "An Oilfree Refrigeration Plant", Grenco Support Center V. V. 's-Hertogenbosch (Netherlands)
3. Green, "The Effect of Oil on Evaporator Performance, ASHRAE meeting, January, 1971, pp. 23–27
4. Palmer
5. Matlock and Clinton (1993) "Polyalkylene Glycols" in Synthetic Lubricants and High Performance Functional Fluids (Marcel Dekker, Inc.) pp. 101–123

6. Mobil Oil Corp., "Refrigeration Compressor Lubrication with Synthetic Fluids"
7. Bulletin No. 108, International Institute of Ammonia Refrigeration (IIAR) "Water Contamination in Ammonia Refrigeration Systems"
8. Short, "Hydrotreated Oils for Ammonia Refrigeration", IIAR Annual Meeting (March 1985)

We claim:

1. A fluid composition for use in compression refrigeration, said fluid composition comprising:

ammonia refrigerant; and a lubricant base fluid composition comprising:

a polyalkylene glycol of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z.

2. A fluid composition as set forth in claim 1, wherein said polyalkylene glycol is the reaction product of an organic oxide and an alcohol.

3. A fluid composition as set forth in claim 2, wherein said alcohol has a chemical structure which contains a larger amount of carbon atoms in relationship to active hydrogen atoms and wherein the molecular weight of said alcohol is about 8 to 55% of the weight of said polyalkylene glycol.

4. A fluid composition as set forth in claim 2 wherein said organic oxide is selected from the group consisting of ethylene oxide, propylene oxide, and butylene oxide.

5. A fluid composition as set forth in claim 2 wherein said polyalkylene glycol has a molecular weight of between about 400 to 2000.

6. A fluid composition as set forth in claim 2 wherein said lubricant composition has a viscosity @40° C. of between about 25 to 150 cSt.

7. A fluid composition as set forth in claim 2 wherein said polyalkylene glycol is both miscible and soluble in ammonia, chlorofluorocarbons, hydrochlorofluorocarbons, and hydrofluorocarbon refrigerants.

8. A fluid composition as set forth in claim 2 wherein said alcohol is selected from the group consisting of benzyl alcohol, octyl phenol, nonyl phenol, di-nonyl phenol, and a $C_{11}$ alcohol.

9. A fluid composition for use in compression refrigeration, said fluid composition consisting essentially of:

ammonia refrigerant; and a lubricant composition consisting essentially of:

a polyalkylene glycol of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z.

10. A fluid composition for use in compression refrigeration, said fluid composition comprising:

ammonia refrigerant; and a lubricant composition comprising:

a polyalkylene glycol made from the reaction product of an organic oxide and an alcohol and of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z; and wherein said lubricant composition includes additives selected from the group consisting of polyglycols, mineral oils, and alkyl benzene.

11. A fluid composition as set forth in claim 10 wherein the concentration of said additives ranges from about 0 to 25% by weight.

12. A method of making a fluid composition for use in lubricating compression refrigeration equipment, using ammonia refrigerant, consisting essentially of combining said ammonia refrigerant with a lubricant base fluid composition wherein the lubricant base fluid composition consists essentially of:

a polyalkylene glycol of the formula $$Z—((CH_2—CH\ (R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z.

13. A method as set forth in claim 12, said polyalkylene glycol is prepared by reacting an organic oxide and an alcohol.

14. A method of making a fluid composition for use in a compression refrigeration system consisting of combining ammonia refrigerant and a lubricant composition wherein said lubricant composition consists of a polyalkylene glycol which is both miscible and soluble in ammonia, and has the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z.

15. A method as set forth in claim 14 wherein the polyalkylene glycol is made from an alkyl alcohol of greater than $C_{10}$.

16. A method as set forth in claim 14 wherein the polyalkylene glycol is made from an aryl alcohol of greater than $C_6$.

17. A method as set forth in claim 16 wherein the aryl alcohol is selected from the group consisting essentially of benzyl alcohol, octyl phenol, nonyl phenol, and di-nonyl phenol.

18. A method as set forth in claim 14 wherein the polyalkylene glycol is made from at least one organic oxide.

19. A method as set forth in claim 18 wherein the organic oxide is at least one of ethylene oxide, propylene oxide, or butylene oxide.

20. A method as set forth in claim 15 wherein the weight of said alcohol is about 8 to 55% of the weight of said polyalkylene glycol.

21. A method of making a fluid composition for use in a compression refrigeration system comprising combining ammonia refrigerant and a lubricant composition comprising a polyalkylene glycol which is both miscible and soluble in ammonia, and has the formula $$Z—((CH_2—CH(R_1)—O)_n—(CH_2—CH(R_1)—O—)_m)_pH$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z; and wherein said lubricant composition includes additives selected from the group consisting of polyglycols, mineral oils, and alkyl benzene.

22. A method as set forth in claim 21 wherein the concentration of the additives ranges from about 0 to 25% by weight.

23. A method for improving lubrication in a compression refrigeration system, using ammonia as a refrigerant, consisting of employing a lubricant base fluid composition with the ammonia refrigerant wherein said lubricant base fluid composition is made by the process of reacting an alcohol and an organic oxide to form a polyalkylene glycol of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z.

24. A method as set forth in claim 23 wherein the alcohol has a chemical structure which contains a larger amount of carbon atoms in relationship to active hydrogen atoms and wherein the molecular weight of said alcohol is about 8 to 55% of the weight of said polyalkylene glycol.

25. A method as set forth in claim 23 wherein the organic oxide is selected from the group consisting of ethylene oxide, propylene oxide, and butylene oxide.

26. A method as set forth in claim 23 wherein the polyalkylene glycol has a molecular weight of between about 400 to 2000.

27. A method as set forth in claim 23 wherein the lubricant base fluid composition has a viscosity @40° C. of between about 25 to 150 cSt.

28. A method as set forth in claim 23 wherein the polyalkylene glycol is both miscible and soluble in ammonia, chlorofluorocarbons, hydrochlorofluorocarbons, and hydrofluorocarbon refrigerants.

29. A method as set forth in claim 23 wherein the alcohol is selected from the group consisting of benzyl alcohol, octyl phenol, nonyl phenol, di-nonyl phenol, and a $C_{11}$ alcohol.

30. A method for improving lubrication in compression refrigeration equipment, using ammonia as a refrigerant, consisting essentially of employing with the ammonia refrigerant a lubricant, wherein said lubricant is made by the process of reacting an alcohol and an organic oxide to form a polyalkylene glycol of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) carbons where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogen of Z.

31. A method for improving lubrication in a compression refrigeration system, using ammonia as a refrigerant, comprising employing a lubricant with the ammonia refrigerant wherein said lubricant is made by the process of reacting an alcohol and an organic oxide to form a polyalkylene glycol of the formula $$Z—((CH_2—CH(R_1)—O)_n—(CH_2—CH(R_1)—O—)_m)_p—H$$

wherein

Z is a residue of a compound having 1–8 active hydrogens and a minimum number of carbon atoms of six (6) where Z is an aryl group and a minimum number of carbon atoms of ten (10) where Z is an alkyl group, $R_1$ is hydrogen, methyl, ethyl, or a mixture thereof, n is 0 or a positive number, m is a positive number, and p is an integer having a value equal to the number of active hydrogens of Z; and wherein said lubricant includes additives selected from the group consisting of polyglycols, mineral oils, and alkyl benzene.

32. A method as set forth in claim 31 wherein the concentration of the additives ranges from about 0 to 25% by weight.

* * * * *

UNITED STATES PATENT AND TRADEMARK OFFICE

CERTIFICATE OF CORRECTION

PATENT NO. : 5,595,678

DATED : January 21, 1997

INVENTOR(S) : Glenn D. Short et al

It is certified that error appears in the above-indentified patent and that said Letters Patent is hereby corrected as shown below:

Column 15, Table 3, item A5, change "130-180°0F." to -- 130-180°F. --.

Claim 17, line 2, delete "essentially".

Claim 21, line 3, change "and" to -- with --.

Signed and Sealed this

Third Day of June, 1997

*Attest:*

*Attesting Officer*

BRUCE LEHMAN

*Commissioner of Patents and Trademarks*